US006629482B2

(12) United States Patent
Elia et al.

(10) Patent No.: US 6,629,482 B2
(45) Date of Patent: Oct. 7, 2003

(54) BOLTLESS CUTTING MAT LOCK UP

(75) Inventors: John Rocco Elia, Arden, NC (US); Jerry Shelton, Fairview, NC (US)

(73) Assignee: Day International, Inc., Dayton, OH (US)

( * ) Notice: Subject to any disclaimer, the term of this patent is extended or adjusted under 35 U.S.C. 154(b) by 0 days.

(21) Appl. No.: 09/881,943

(22) Filed: Jun. 15, 2001

(65) Prior Publication Data

US 2002/0189419 A1 Dec. 19, 2002

(51) Int. Cl.[7] ..... B26D 7/20
(52) U.S. Cl. ..... 83/659; 83/347; 83/698.42
(58) Field of Search ..... 83/659, 347, 648.42, 83/13, 348, 346, 510, 511

(56) References Cited

U.S. PATENT DOCUMENTS

| | | | |
|---|---|---|---|
| 3,522,754 | A | 8/1970 | Sauer |
| 3,739,675 | A | 6/1973 | Duckett et al. |
| 3,765,329 | A | 10/1973 | Kirkpatrick et al. |
| 3,880,037 | A | 4/1975 | Duckett et al. |
| 3,882,750 | A | 5/1975 | Duckett et al. |
| 3,885,486 | A | 5/1975 | Kirkpatrick |
| 4,031,600 | A | 6/1977 | Whigam |
| 4,073,207 | A | 2/1978 | Kirkpatrick |
| 4,075,918 | A | 2/1978 | Sauer |
| 4,191,076 | A | 3/1980 | Bollmer et al. |
| 4,240,192 | A | 12/1980 | Davis |
| 4,240,312 | A | 12/1980 | Ward, Sr. |
| 4,378,737 | A | 4/1983 | Kirkpatrick |
| 4,791,846 | A | 12/1988 | Kirkpatrick |
| 4,848,204 | A | 7/1989 | O'Conner et al. |
| 4,867,024 | A | 9/1989 | Cho et al. |
| 4,982,639 | A | 1/1991 | Kirkpatrick |
| 5,076,128 | A | 12/1991 | O'Conner et al. |
| 5,078,535 | A | 1/1992 | Kirkpatrick |
| 5,720,212 | A | 2/1998 | Kirkpatrick |
| 5,758,560 | A | 6/1998 | Fiscus |
| 5,906,149 | A | 5/1999 | Montenetro Criado |
| 5,916,346 | A | 6/1999 | Neal |
| 6,116,135 | A | 9/2000 | Wagner |
| 6,135,002 | A | 10/2000 | Neal |

*Primary Examiner*—Paul T. Sewell
*Assistant Examiner*—Thanh P Duong
(74) *Attorney, Agent, or Firm*—Killworth, Gottman, Hagan & Schaeff LLP

(57) ABSTRACT

A cutting mat comprises a cutting mat body and a lock assembly arranged to secure the cutting mat to a rotary anvil. The lock assembly comprises male and female locking members formed at opposite ends of the cutting mat and integral therewith. There are no metal frames or other components welded or otherwise secured to the male or female locking members. The female locking member slips into an axial channel on a rotary anvil. The cutting mat is wrapped around the rotary anvil, and the male member is inserted into the axial channel in locking relationship with the female locking member. Further, the axial edges of the cutting mat are formed in mating, complimentary serpentine shape to prevent a cutting blade from slipping into the seam between adjacent cutting mat surfaces.

24 Claims, 6 Drawing Sheets

BOLTLESS CUTTING MAT LOCK UP

BACKGROUND OF THE INVENTION

The present invention relates in general to a locking arrangement for flexible, annular covers and in particular, to locking members formed integral with a cutting mat for securing to a rotary anvil.

Rotary die cutting machines are used to cut a continuously moving workpiece by passing the workpiece through the nip of a cutting roller and a rotary anvil. The cutting roller includes any combination of cutting blades or rules, and scoring elements projecting from the surface thereof. The rotary anvil provides a suitable surface to support the workpiece at the point where the work material is cut or scored by the cutting roller. Essentially, the rotary anvil serves as a backstop allowing the cutting blades to be urged against the workpiece being cut without damaging the cutting blades themselves. Because of the speed of operation, rotary die cutting machines are used to perform cutting operations in numerous industries. For example, the corrugated industry utilizes such machines to cut and score corrugated paperboard materials for constructing packaging products such as boxes and shipping containers.

Typically, several cutting mats are axially aligned on the rotary anvil. Each cutting mat is constructed of a deformable material such as a polymeric composition. The outer surface of each cutting mat is sufficiently rigid to give adequate support to the work material, yet soft enough so that the cutting blades will not wear or be damaged by impact with the rotary anvil. The cutting blades on the cutting roller penetrate the cutting mats in operation. This leads to eventual fatigue and wear of the cutting mats, requiring periodic replacement.

At times, rotary die cutting machines are set up to feed a workpiece centrally, and as such, the full width of the rotary die cutting machine is not used. Under this circumstance, the cutting mats located generally in the central portion of the rotary anvil experience most of the wear. Likewise, the cutting mats located at the opposing end portions of the rotary anvil receive the least wear. Rotating the relative positions of the cutting mats on the rotary anvil such that the cutting mats wear more evenly may prolong the serviceable life of cutting mats. However, repositioning the cutting mats causes downtime because the rotary die cutting machine cannot be in operation when changing or adjusting the cutting mats. The number of cutting mats on a typical rotary anvil can range from eight to fourteen mats, thus the downtime can become substantial. Further, as the cutting mats wear, the quality of the cutting operation deteriorates. However, because of downtime, the industry tendency is to prolong the time between cutting mat changeovers. This leads to a greater possibility of poor quality cuts.

Several techniques have been devised to secure the cutting mat to the rotary anvil. For example, several known cutting mats include opposing flanged end portions that are received in a lock up channel axially extending along the surface of the rotary anvil. However, the flanged portions of such cutting mats are formed either by welding a frame to the end portions of the cutting mat to define the respective flanges, or otherwise adhering a metal liner to the interior surface of the cutting mat, then bending numerous folds into the liner until the liner defines the framed flange. Such approaches are costly and complicate the manufacturing process. Further, a seam is created where the ends of the cutting mat meet in the axial channel. Should a cutting blade strike the cutting mat along that seam, the cutting blade can slip between the end portions of the cutting mat potentially damaging the cutting blade.

Still other lockup devices comprise complimentary interlocking fingers cut into opposing ends of the cutting mat. Such devices attempt to eliminate the use of flanged end portions of a cutting mat. For example, one cutting mat construction comprises opposite ends having a plurality of complimentary fingers and receivers. The cutting mat is wrapped around the rotary anvil, and the ends are joined in puzzle like fashion. However, this construction may not provide suitable holding strength and the cutting mat may slip. Further, the ends of the cutting mat may pull away or slightly lift from engagement with each other causing one or more ridges or humps to be formed on the outer surface of the cutting mat. These ridges may interfere with the smooth operation of the rollers and as such, are detrimental to the rotary die cutting procedure. Cutting mats that incorporate interlocking fingers can also be difficult to install and mount leading to increased downtime, and infrequent cutting mat changeover.

SUMMARY OF THE INVENTION

The present invention overcomes the disadvantages of previously known locking systems for cutting mats by providing a lockup device that allows for rapid cutting mat changeover, and installation. The cutting mat comprises a cutting mat body and a lock assembly arranged to secure the cutting mat to a rotary anvil. The lock assembly comprises male and female locking members positioned at opposite ends of the cutting mat and formed integral therewith. The female locking member slips into an axial channel on a rotary anvil. The cutting mat is wrapped around the rotary anvil, and the male member is inserted into the axial channel in locking relationship with the female locking member. The female and male locking members are constructed of the same material as the remainder of the cutting mat and formed integral therewith resulting in a one-piece construction that enables rapid cutting mat changeover. Rapid cutting mat changeover is realized because there are no bolts, latching strips, glue or additional components such as lockup devices required for installation. Additionally, the cutting mat is non-directional when placed on a rotary anvil.

To prevent a cutting blade from slipping between the male and female locking members during cutting operations, the opposing axial edges of the cutting mat are formed in a complimentary nonlinear pattern. For example, the axial edges of the cutting mat are formed in a mating serpentine shape. As such, the axial seam defined between the female and male locking members is not linear as taken across the entire width of the cutting mat ensuring that a cutting blade will always strike at least a portion of the cutting mat surface. Further, the serpentine shaped joint or seam allows for better alignment of adjacent cutting mats.

Accordingly, it is an object of the present invention to provide a cutting mat having complimentary, nonlinear axial edges arranged such that when the cutting mat is installed on a rotary anvil, the axial edges mate together to define a nonlinear seam arranged to prevent a cutting blade from slipping through the seam.

It is another object of the present invention to provide a cutting mat having female and male locking members formed integral with the cutting mat.

It is an object of the present invention to provide a cutting mat that secures to the cylinder portion of a rotary anvil using frictional forces only.

It is still another object of the present invention to provide a cutting mat having a lock assembly that allows for quick cutting mat changeover and replacement without disturbing adjacent cutting mats.

Other features of the present invention will become apparent in light of the description of the invention embodied herein, the accompanying drawings, and the appended claims.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENTS

Figure 1:
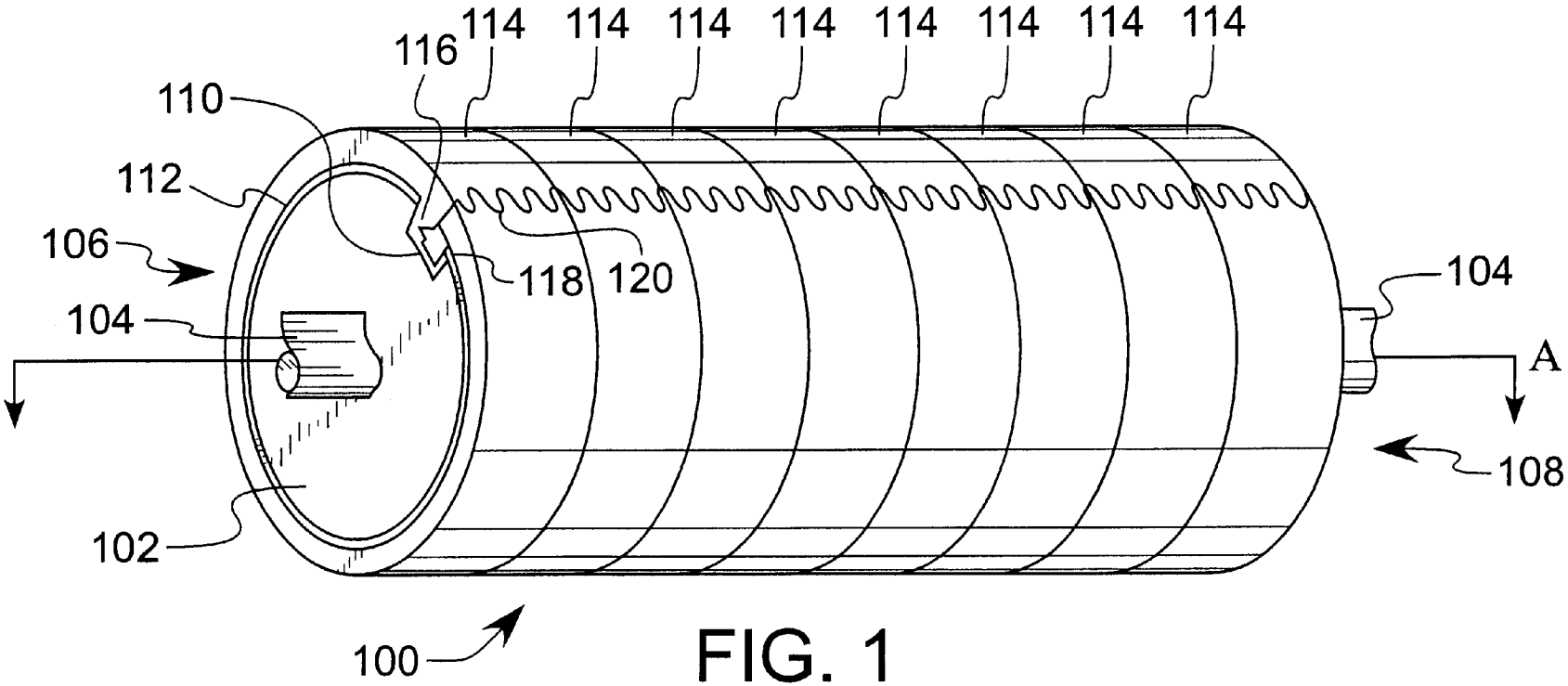
FIG. 1 is a perspective view of a typical rotary anvil having a plurality of cutting mats wrapped around a cylindrical portion and locked into an axially extending channel.

In the following detailed description of the preferred embodiments, reference is made to the accompanying drawings that form a part hereof, and in which are shown by way of illustration, and not by way of limitation, specific preferred embodiments in which the invention may be practiced. It will be appreciated that these are diagrammatic figures, and that the illustrated embodiments are not shown to scale. Further, like structure in the drawings is indicated with like reference numerals throughout.

FIG. 1 illustrates an exemplary rotary anvil 100. The rotary anvil 100 comprises a generally cylindrical anvil portion 102. A shaft 104 extends from opposite end faces 106, 108 of the anvil portion 102, and is particularly adapted to support the rotary anvil 100 for rotation on associated support bearings (not shown) as is known in the art. A channel 110 extends axially along the surface 112 of the anvil portion 102. Any number of cutting mats 114 are wrapped around the surface 112 of the anvil portion 102 and secured thereto, by engaging opposing female and male locking members 116, 118 of the cutting mat 114 in the channel 110.

The cutting mats 114 each comprise a compressible resilient elastomeric material and may include known processing, stabilizing, strengthening and curing additives as is known in the art. For example, any suitable natural or synthetic polymeric material such as polyurethane, polyvinyl chloride, chlorinated butyl rubber, and like compositions may be used. The cutting mats 114 may further optionally include a backing material (not shown). The backing material may be any suitable material employed in the art for this purpose such as a woven or non-woven fabric or thin flexible sheet material such as sheet metal.

The cutting mats 114 are wrapped around the surface 112 of the anvil portion 102 such that the female and male locking members 116 and 118 mate in the channel 110 and define a seam 120. As shown, the seam 120 is generally of a serpentine shape. The serpentine shaped seam 120 ensures that a cutting blade (not shown) cannot penetrate between the female and male locking members 116 and 118 and will always strike the cutting mat 114. The seam 120 also allows for better alignment of the cutting mat with adjacent cutting mats. It shall be appreciated that seam 120 between the female and male locking members 116 and 118 may form any other patterned seam 120 such as saw tooth, serrations, undulations, sinusoids, zigzags, bends, curvilinear patterns, or any other shape so long as the seam 120 does not remain straight and linear along its entire length in a direction generally parallel to the cutting blade (not shown). Further, the serpentine shaped seam 120 illustrated in FIG. 1 is exaggerated for illustrative purposes. It shall be observed that the seam 120, irrespective of the shape utilized, will be limited by the dimensions of the channel 110.

Figure 2:
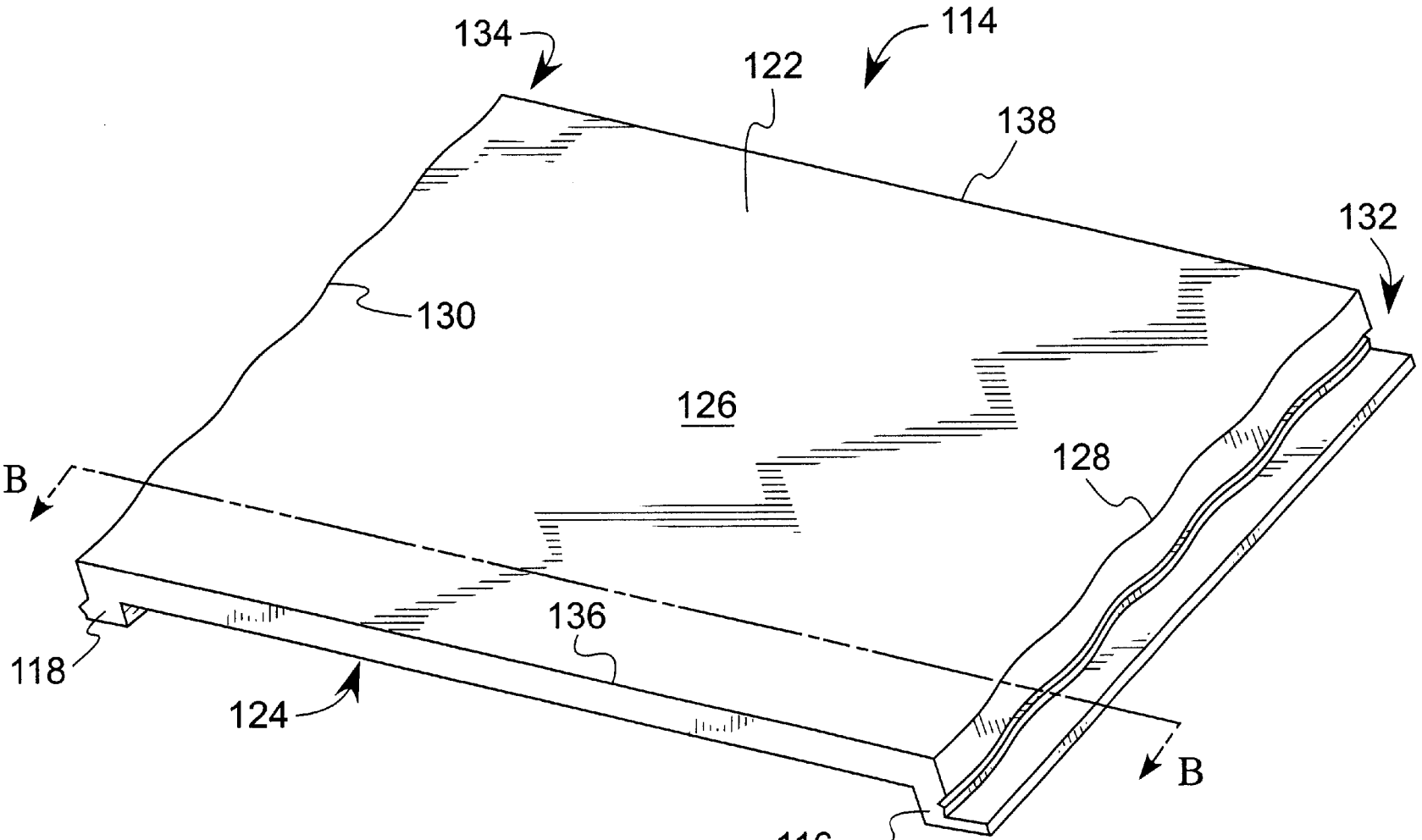
FIG. 2 is a perspective view of one embodiment of the cutting mat according to the present invention.

As shown in FIG. 2, the cutting mat 114 comprises a cutting mat body 122 having a first major surface 124 and a second major surface 126. Opposing first and second axial edges 128 and 130 are complimentary and nonlinear. By complimentary, it is meant that that the cutting mat 114 is wrappable into a cylindrical shape such that the first and second axial edges 128 and 130 abut each other in mating relationship. Further, by nonlinear, it is meant that the first and second axial edges 128 and 130 are not straight, linear edges throughout their respective entire lengths. When installed on a rotary anvil (not shown in FIG. 2), the first and second axial edges 128 and 130 abut defining seam 120 discussed with reference to FIG. 1. As shown in FIG. 2, the first and second axial edges 128, 130 form complimentary serpentine shapes.

The female locking member 116 projects from the first end portion 132 generally normal to the cutting mat 114 and in the direction of the first major surface 124. The first end portion 132 refers generally to the end of the cutting mat 114 proximate to the first axial edge 128. The male locking member 118 projects from the second end portion 134 generally normal to the cutting mat 114 and in the direction of the first major surface 124. The second end portion 134 refers generally to the end of the cutting mat 114 proximate to the second axial edge 130. First and second transverse edges 136 and 138 are generally linear throughout their length. The transverse length of the cutting mat will be dictated by the diameter of the rotary anvil to which the cutting mat is to be mountable.

Figure 3:
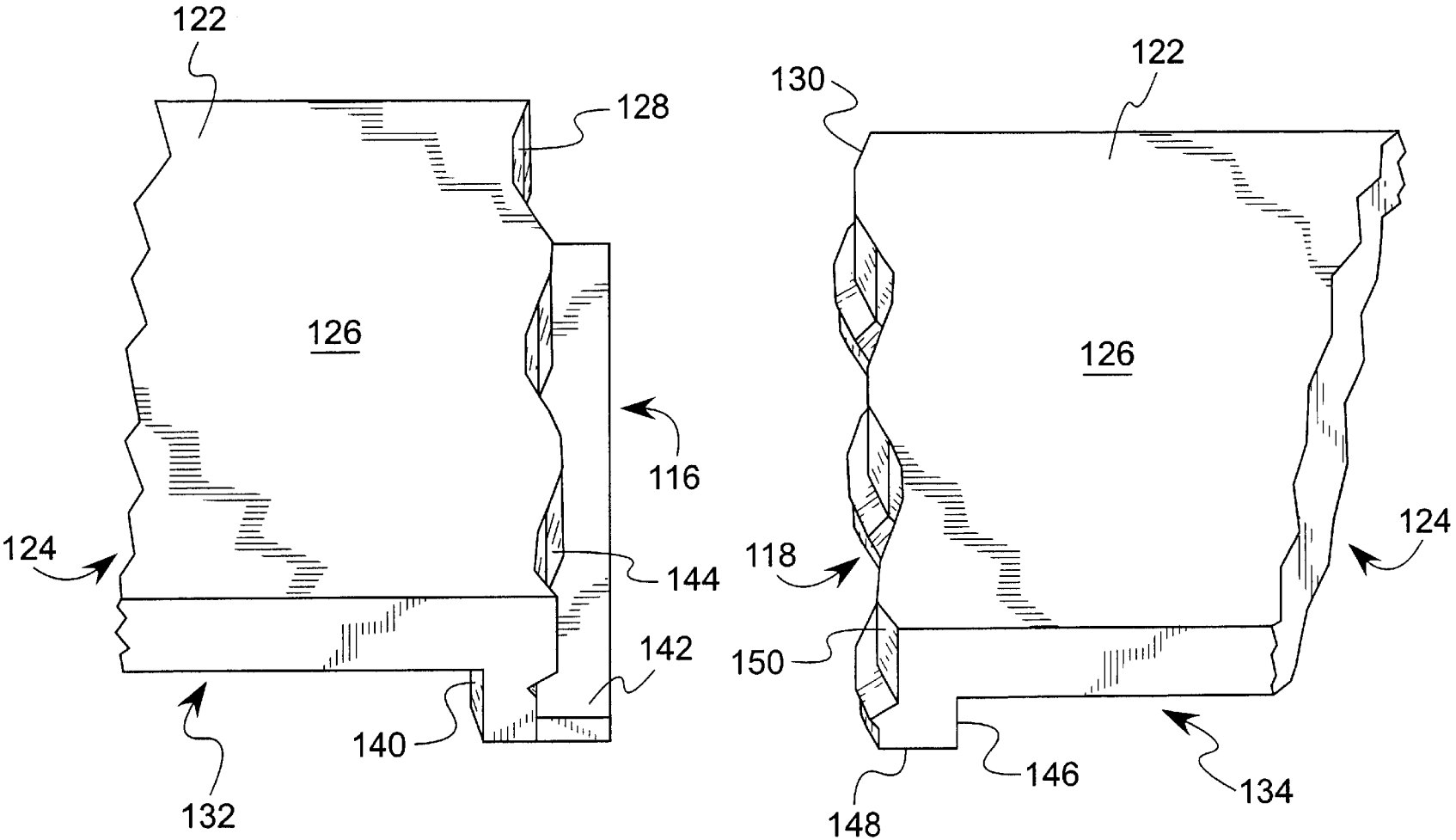
FIG. 3 is a fragmentary perspective view of the end portions of an embodiment of the cutting mat according to the present invention.

Referring to FIG. 3, the first and second end portions 132 and 134 are shown in facing relationship (as they would be when wrapped around anvil portion 102). The female locking member 116 includes a first sidewall 140 projecting generally normal to the cutting mat body 122 in the direction of the first major surface 124 and facing towards the cutting mat body 122. A base portion 142 projects from the end of the first sidewall 140 generally normal thereto. The base portion 142 projects generally in a direction away from the cutting mat body 122. A female mating face 144 extends from the first axial edge 128 to the base portion 142 generally opposite the first sidewall 140. The male locking member 118 includes a second sidewall 146 projecting generally normal to the cutting mat body 122 in the direction of the first major surface 124 and facing towards the cutting mat body 122 in a fashion similar to that of the sidewall 140 on the female locking member 116. A base portion 148 extends from the second sidewall 146 generally normal thereto, in a direction away from the cutting mat body 122. A male mating face 150 extends from the second axial edge 130 to the base portion 148. The female and male mating faces 144 and 150 generally follow the contours defined by the first and second axial edges 128 and 130 respectively.

Figure 4:
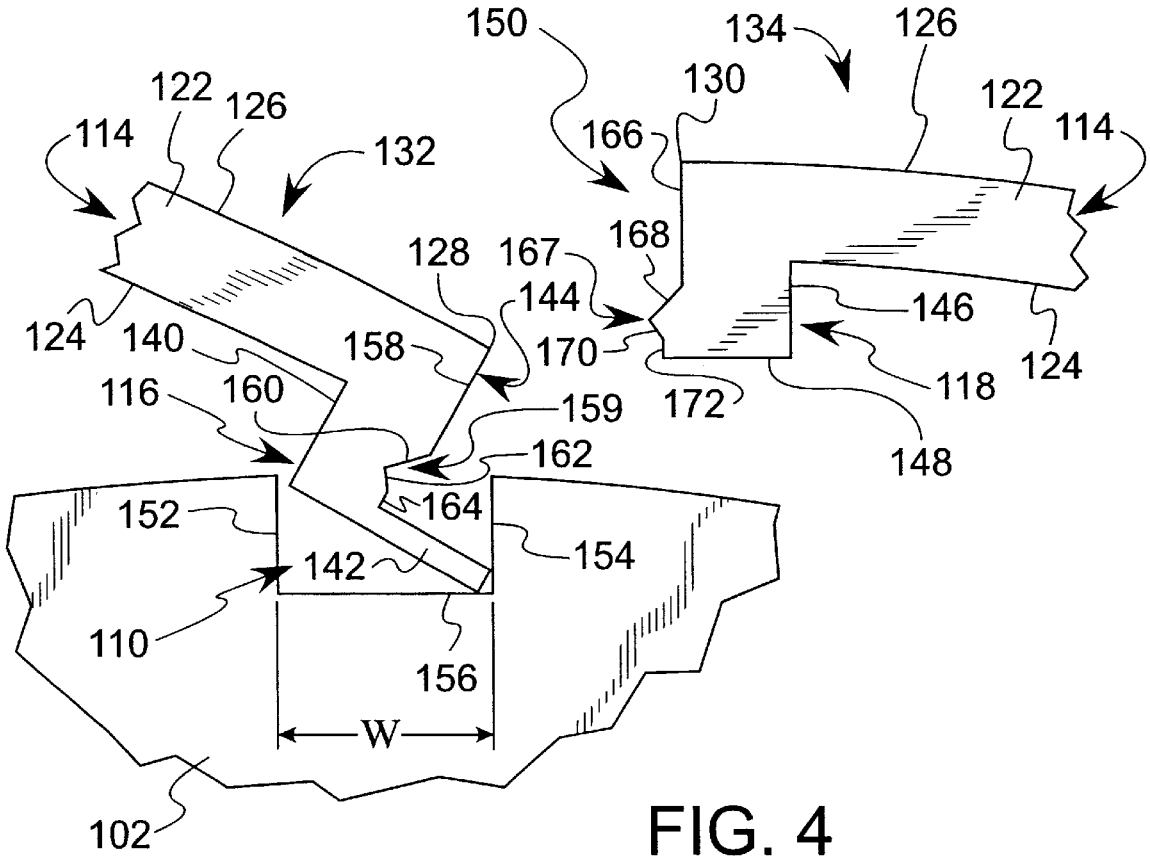
FIG. 4 is an enlarged fragmentary end view of the rotary anvil of FIG. 1 showing the cutting mat of FIG. 2 in the process of being installed in an axially extending channel.
Figure 5:
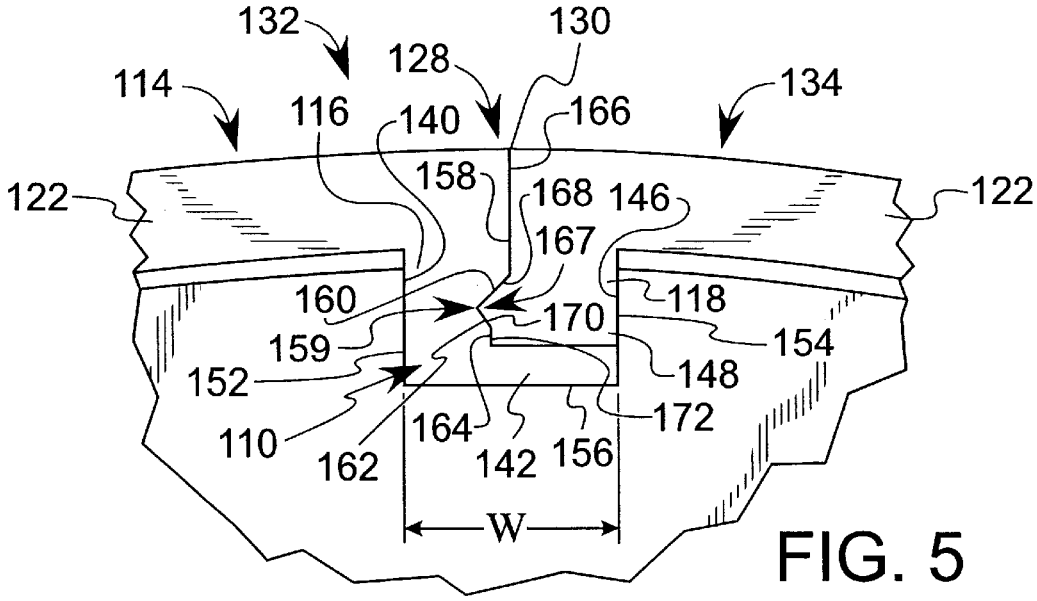
FIG. 5 is an enlarged fragmentary end view of the rotary anvil of FIG. 1 showing the cutting mat of FIG. 2 installed in the axially extending channel.

Referring to FIGS. 4 and 5, the process of installing the cutting mat 114 onto the rotary anvil 100 is illustrated. The channel 110 includes first and second channel walls 152 and 154, and a channel floor 156. The channel floor has a channel width W. As best illustrated in FIG. 4, the female mating face 144 of the female locking member 116 comprises a first mating surface 158 and a first locking recess 159. The first locking recess 159 defines a first locking surface 160 and a second locking surface 162. Further, an optional second mating surface 164 may be provided. The male mating face 150 comprises a third mating surface 166, and a locking projection 167. The locking projection comprises a third locking surface 168 and a fourth locking surface 170. Further, the male mating fact 150 may optionally include a fourth mating surface 172.

The female locking member 116 is inserted into the channel 110 first. When the female locking member 116 is properly seated in the channel 110, the base portion 142 of the female locking member 116 rests on the channel floor 156 and the first sidewall 140 presses against the first channel wall 152. Accordingly, the base portion 142 should be dimensioned to generally coincide with the channel width W of the channel floor as best illustrated in FIG. 5. Further, the first sidewall 140 of the female locking member 116 is dimensioned generally to the same height as the first channel wall 152. After the female locking member 116 is properly seated in the channel 110, the cutting mat is wrapped around the rotary anvil, and the male locking member is inserted into the channel 110.

Referring to FIG. 5, when the male and female locking members 116 and 118 are properly seated in the channel 110, the base portion 142 of the female locking member 116 presses against the channel floor 156. The first sidewall 140 of the female locking member 116 presses against the first channel wall 152. In a complimentary fashion, the second sidewall 146 of the male locking member 118 presses against the second channel wall 154. The base portion 148 of the male locking member 116 presses against the top of the base portion 142 of the female locking member 116.

The first and second mating surfaces 158 and 164 of the female locking member 116 are sized and dimensioned to mate with and press against the third and fourth mating surfaces 166 and 172 of the male locking member 118. Further, at least a portion of the first mating surface 158 generally follows the contour of the first axial edge 128. Likewise, at least a portion of the third mating surface 166 generally follows the contour of the second axial edge 130. As such, lateral support is provided. The locking recess 159 is dimensioned to receive the locking projection 167. As illustrated, the first and second locking surfaces 160 and 162 are dimensioned to receive the third and fourth locking surfaces 168 and 170. This arrangement ensures that the first and second axial edges 128 and 130 are secured to the rotary anvil, and the first and second end portions 132 and 134 are prevented from lifting or otherwise moving radially from the rotary anvil. It shall be observed that under this arrangement, the cutting mat 114 is releasably secured to the rotary anvil 102 by frictional forces only. It shall be appreciated that additional locking and/or mating surfaces may be provided within the spirit of the present invention. Further, the geometry and positioning of the locking recess 159 and locking projection 167 may vary as specific applications dictate.

There are no latching strips, bolts, screws, lockup devices, glue, or other components required. Accordingly, a quick cutting mat changeover time is realized. This enables more efficient mounting of cutting mats 114 on the rotary anvil 100, such as for rotation of cutting mats 114, or in the replacement of worn cutting mats 114 because there is no preparation work to the rotary anvil 100, the channel 110 or to the cutting mat 114 prior to installation. Further, the serpentine shape of the first and second axial edges 128, 130 allows the cutting mat to align more easily with adjacent cutting mats. Also, the cutting mat 114 is non-directional when installed on the rotary anvil. That is, while shown in FIG. 5 with the first side wall 140 of the female locking member 116 pressing against the first channel wall 152, the cutting mat 114 may optionally be flipped around such that the first side wall 140 of the female locking member 116 presses against the second channel wall 154.

It shall further be appreciated that any portions of either of the female mating face 144 and the male mating face 150 may include surface textures or surface characteristics such as knurls or similar features arranged to provide additional lateral stability to the cutting mat 114.

The number of curves or angles in the seam 120 will depend upon factors such as the axial length of the cutting mat 114. Further, the amplitude from peak to valley of each of the first and second axial edges 128, 130 will depend upon the channel width W. For example, the cutting mat 114 may have an axial length of generally 10 inches (25.4 centimeters). The channel width W of the channel 110 may be around one inch (2.54 centimeters). A suitable pattern for the first and second axial edges 128 and 130 is a serpentine or sinusoidal pattern having a period P of approximately two inches (5.08 centimeters), and an amplitude C of approximately one eighth of an inch (0.3175 centimeters). Under this arrangement, it shall be observed that the seam 120 formed by the abutting first and second axial edges will not remain parallel to a cutting blade (not shown) sufficient to allow the cutting blade to slip through the seam 120.

The male and female locking members 116 and 118 are formed integral with the cutting mat body 122 resulting in a one-piece construction. There are no metal, frames, or other materials exposed on the surfaces of the first and second locking members 116 and 118. This allows a tight fit in the channel 110, and accordingly, lateral as well as radial stability is provided to the cutting mat 114. Further, because there is no metal on either the female mating face 144 or the male mating face 150, a strong frictional mating can be realized by compressing the cutting mat material directly against itself. Further, should a cutting blade (not shown) slip through the seam 120, there are no metal components to dull or damage the blade. However, it may be advantageous to provide support for the female and male locking members 116 and 118.

Figure 6:
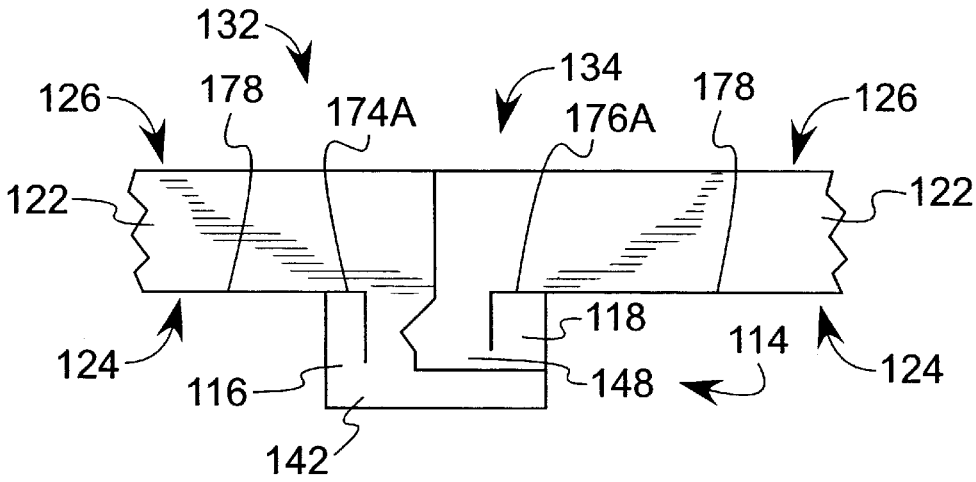
FIG. 6 is a fragmentary cross sectional view of the cutting mat of FIG. 2 taken along Line B where the end portions of the cutting mat are in mating relation with one another, illustrating reinforcing in the locking members according to one embodiment of the present invention.

The female locking member 116 is formed integral with the cutting mat body 122. For example, where the cutting mat body 122 comprises a polyurethane material, the female locking member 116 is also polyurethane and formed as a continuous flange projecting from the first end portion 132. This construction technique results in a female locking member 116 that is deformable and can thus be securely fitted into the channel 110. Likewise, the male locking member 118 is formed integral with the cutting mat body 122 as well, projecting as a flange extending from the second end portion 134. The first and second locking members 116 and 118 may be formed integral with the cutting mat body 122 for example, using molds or other similar processes. Referring to FIG. 6, the female and male locking members 116 and 118 are shown in a mating relationship, in a cross-sectional view taken along Line B of FIG. 2. Where it is desirable to add stiffening to the female locking member 116, a first support 174A is provided. The first support 174A is preferably a rigid material such as a piece of sheet metal formed inside the female locking member 116. Preferably, no portion of the first support 174A is exposed.

As illustrated, the first support 174A extends generally in a right angle pattern. The first support 174A projects into the female locking member 116 from the cutting mat body 122 and projects generally down towards the base portion 142. Similarly, a second support 176A extends generally into the male locking member 118, and projects generally down towards the base portion 148. It shall be appreciated that the second support 176A may be constructed of the same materials as the first support 174A. Further, the first and second supports 174A and 176A may be a single, continuous sheet that extends the entire transverse length of the cutting mat 114. For example, where the cutting mat 114 includes an optional liner 178 secured to the first major surface 124, the end portions of the metal liner may be bent into the respective first and second supports 174A and 174B. Alternatively, the first and second supports 174A and 176A may comprise metal supports distinct from, and in addition to, the liner 178 secured to the first major surface.

Figure 7:
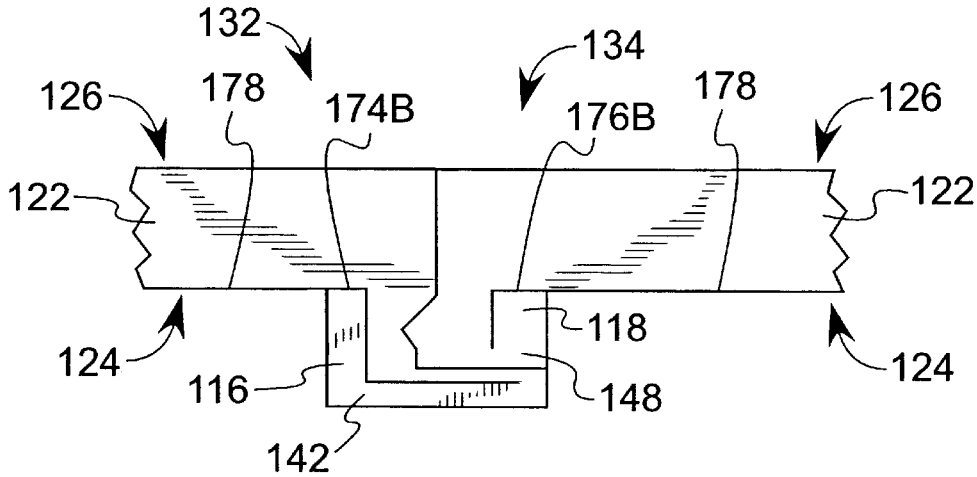
FIG. 7 is a fragmentary cross sectional view of the cutting mat of FIG. 2 taken along Line B where the end portions of the cutting mat are in mating relation with one another, illustrating reinforcing in the locking members according to another embodiment of the present invention.

FIGS. 7–11 illustrate several variations on the first support 174A and are referenced as first support 174B–174F respectively. Further, several variations on the second support 176A are referenced as 176B–176F respectively. Referring to FIG. 7, the first support 174B includes a pair of generally right angle bends such that the first support extends into the first locking member 116, projects downward towards the base portion 142, then extends along the length of the base portion 142, thus providing additional stiffness to the base portion 142. The second support 176B extends into the male locking member 118, and projects downward towards the base portion 148.

Figure 8:
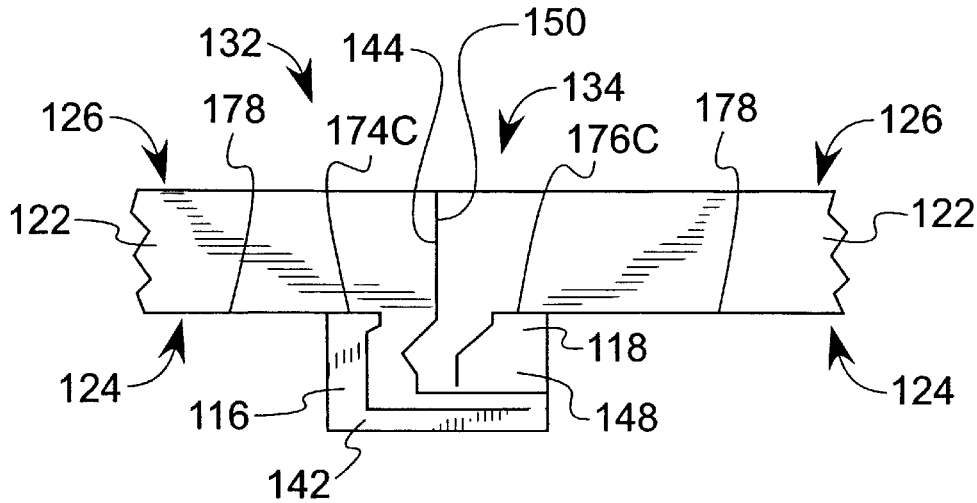
FIG. 8 is a fragmentary cross sectional view of the cutting mat of FIG. 2 taken along Line B where the end portions of the cutting mat are in mating relation with one another, illustrating reinforcing in the locking members according to one embodiment of the present invention.

Referring to FIG. 8, the first support 174C extends into the first locking member 116, then includes one or more angled bends such that the first support 174C recesses back towards the cutting mat body 122, projects downward towards the base portion 142, then extends along the length of the base portion 142, thus providing additional stiffness to the female mating face 144 generally, and to the base portion 142 of the first locking member 116. The second support 176C extends into the male locking member 118, and includes one or more bends projecting generally angularly downward towards the base portion 148 thus providing additional stiffness towards the male mating face 150.

Figure 9:
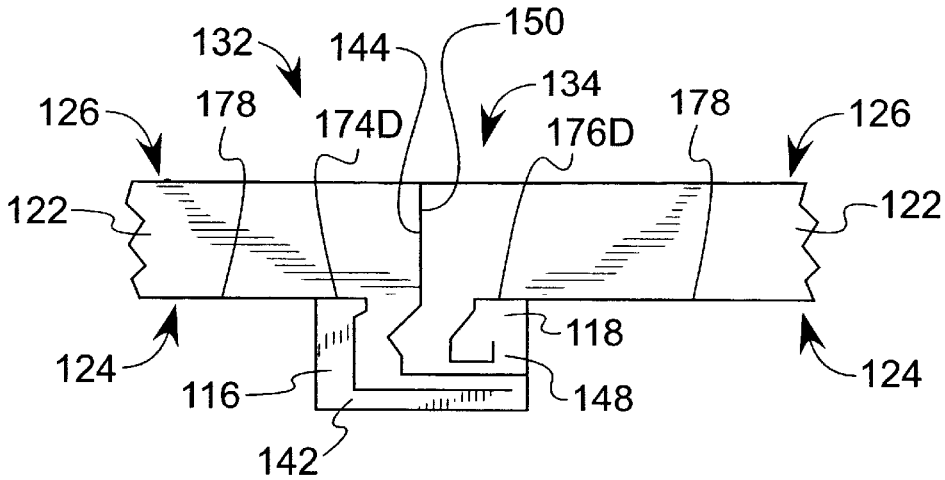
FIG. 9 is a fragmentary cross sectional view of the cutting mat of FIG. 2 taken along Line B where the end portions of the cutting mat are in mating relation with one another, illustrating reinforcing in the locking members according to one embodiment of the present invention.

Referring to FIG. 9, the first support 174D extends into the first locking member 116, then includes one or more angled bends such that the first support 174D recesses back towards the cutting mat body 122, projects downward towards the base portion 142, then extends along the length of the base portion 142, thus providing additional stiffness to the female mating face 144 generally, and to the base portion 142 of the first locking member 116. The second support 176D extends into the male locking member 118, and includes one or more bends projecting generally angularly downward towards the base portion 148 before curling upwards, thus providing additional stiffness towards the male mating face 150.

Figure 10:
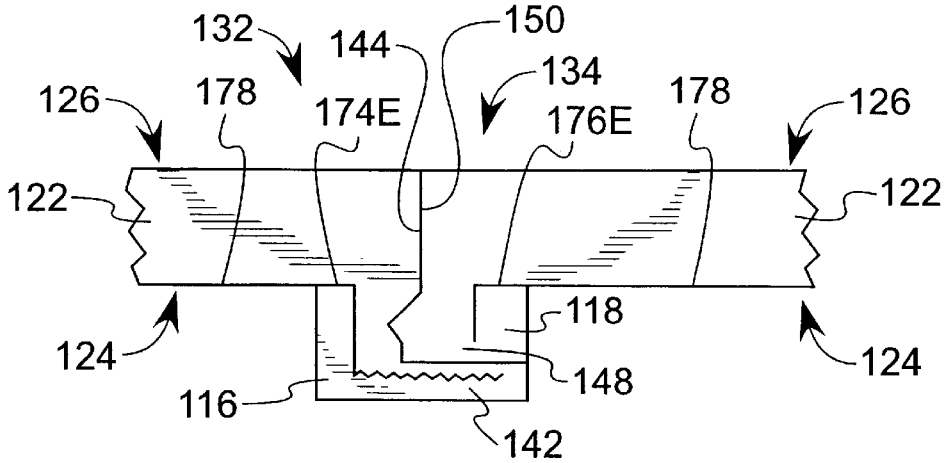
FIG. 10 is a fragmentary cross sectional view of the cutting mat of FIG. 2 taken along Line B where the end portions of the cutting mat are in mating relation with one another, illustrating reinforcing in the locking members according to one embodiment of the present invention; and, FIG. 11 is a fragmentary cross sectional view of the cutting mat of FIG. 2 taken along Line B where the end portions of the cutting mat are in mating relation with one another, illustrating reinforcing in the locking members according to one embodiment of the present invention.

Referring to FIG. 10, the first support 174E extends into the first locking member 116, then includes one or more angled bends such that the first support 174D projects downward towards the base portion 142, then extends along the length of the base portion 142. At least a portion of the first support 174E is corrugated or otherwise includes parallel furrows and ridges for extra stiffness. The second support 176E extends into the male locking member 118, and includes one or more bends projecting generally downward towards the base portion 148.

Figure 11:
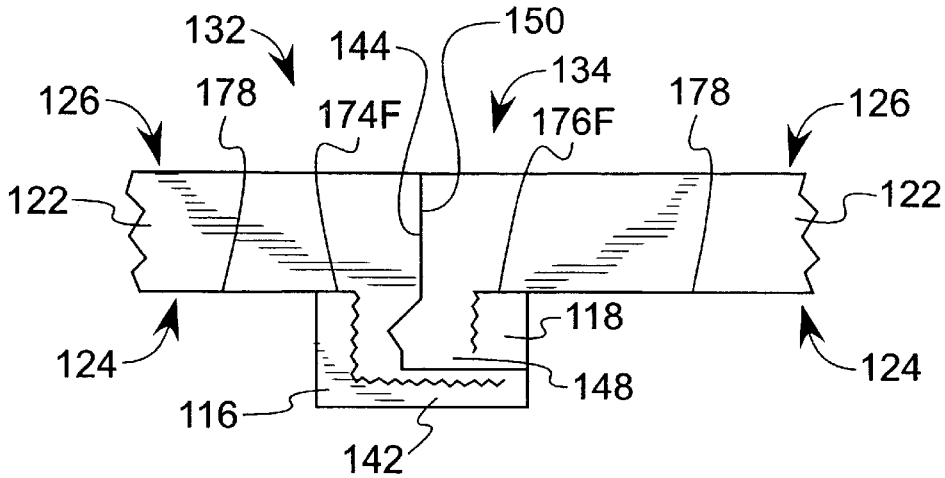

Referring to FIG. 11, it shall be seen that any portion of either the first or second supports 174F, 176F may include corrugated portions. Referring generally to FIGS. 6–11, it shall further observed that other geometries for the first and second supports 174A–F and 176A–F are possible within the spirit of the present invention.

During use, several cutting mats 114 may be axially aligned on the rotary anvil 100 as shown in FIG. 1. The serpentine shaped seam 120 assists a user in suitably aligning adjacent cutting mats 114. Should excess wear be evidenced on one of several cutting mats 114, there is now, no longer a need to grind down or rotate the entire set of cutting mats 114. A user may simply release the worn cutting mat by grasping and pulling generally in the area of the male locking member 118 to release the cutting mat 114 from the channel 110, rotate the mat end for end, and reposition it back in place without disturbing the remainder of the cutting mats. This is possible because the cutting mat 114 is non-directional when installed on the rotary anvil 100. Referring generally to FIGS. 1–11, it is preferable that the male locking member 118 is generally thicker than the female locking member 116 to provide a large surface to snap into place while the cutting mat 114 is under pressure from being wrapped around the rotary anvil 100.

Frequent rotation of cutting mats is known to extend the life of the mat. This is now feasible in a production environment due to the quick and effortless changeover time. Further, because there are no bolts, glue or other fasteners holding the cutting mats 114 in place, it is possible to locate the cutting mats 114 to cover only the area being used for cutting. That is, any one cutting mat 114 is infinitely repositionable within the channel 110. As such, there is no longer a need to cover the entire rotary cylinder 100. Further, a single cutting mat 114 may now be easily removed without disturbing adjacent cutting mats 114.

Having described the invention in detail and by reference to preferred embodiments thereof, it will be apparent that modifications and variations are possible without departing from the scope of the invention defined in the appended claims.

What is claimed is:

1. A rotary anvil cutting mat comprising:

a generally elongate body;

opposing, complimentary, first and second axial edges arranged so as to be nonlinear in an axial dimension;

a first end portion proximate said first axial edge and a second end portion proximate said second axial edge;

a female locking member projecting from said first end portion generally normal thereto, said female locking member comprising a locking recess that generally follows the contour defined by said first axial edge such that said locking recess is nonlinear in said axial dimension; and, a male locking member projecting from said second end portion generally normal thereto, said male locking member comprising a locking projection that generally follows the contour defined by said second axial edge such that said locking projection is nonlinear in said axial dimension, wherein said cutting mat is wrappable into a generally cylindrical shape such that said female and male locking members abut in mating relationship, said locking projection is received by said locking recess and said first and second axial edges define a nonlinear seam therebetween.

2. A rotary anvil cutting mat according to claim 1, wherein said first and second axial edges each form a complimentary curvilinear pattern.

3. A rotary anvil cutting mat according to claim 1, wherein said first and second axial edges each form complimentary serpentine patterns.

4. A rotary anvil cutting mat according to claim 1, wherein said female locking member further comprises a first mating surface that corresponds generally to the contour defined by said first axial edge such that said first mating surface is nonlinear in said axial dimension, and said male locking member further comprises a second mating surface that corresponds generally to the contour defined by said second axial edge such that said second mating surface is nonlinear in said axial dimension, wherein said first and second mating surfaces meet providing lateral support to said cutting mat when cutting mat is wrapped in said generally cylindrical shape.

5. A rotary anvil cutting mat according to claim 1, wherein said locking recess and said locking projection extend substantially the entire axial length of said cutting mat.

6. A rotary anvil cutting mat according to claim 1, wherein said female and male locking members are formed integral with said body.

7. A rotary anvil cutting mat according to claim 1, further comprising a first support embedded within said female locking member, and a second support embedded within said male locking member.

8. A rotary anvil cutting mat according to claim 7, wherein said first support comprises a corrugated metal.

9. A rotary anvil cutting mat according to claim 7, wherein:

said female locking member comprises a first side wall projecting generally normal to said first end portion and facing in the direction of said generally elongate body, a female mating face opposite said first side wall, and a base portion extending generally normal to said first side wall and away from said generally elongate body; and, said first support extends through said female locking member between said first side wall and said female mating face, and extends into said base portion.

10. A cutting mat for a rotary anvil, the rotary anvil having a cylindrical periphery and an axial channel extending along the surface thereof, the cutting mat comprising:

a generally elongate body;

opposing first and second axial edges arranged to form a complimentary, repeating nonlinear pattern in a first axial dimension;

a first end portion proximate said first axial edge and a second end portion proximate said second axial edge;

a female locking member formed integral with said first end portion projecting generally normal thereto; and, a male locking member formed integral with said second end portion projecting generally normal thereto, wherein said cutting met is adapted to be installed on said rotary anvil such that said body wraps around said cylindrical periphery of said rotary anvil and said male and female locking members meet in mating relationship within said channel, said mating relationship of said male and female locking members within said channel sufficient to maintain said cutting mat on said rotary anvil without further requiring bolts, glue or latching strips, and wherein said first and second axial edges define a seam that is nonlinear across the entire length thereof.

11. A cutting mat according to claim 10, wherein said first and second axial edges each form a complimentary curvilinear pattern.

12. A cutting mat for a rotary anvil according to claim 10, wherein said first and second axial edges each form a complimentary serpentine pattern.

13. A cutting mat for a rotary anvil according to claim 10, wherein said female locking member comprises a first mating surface and a locking recess that each correspond generally to the contour defined by said first axial edge so as to be nonlinear in said axial dimension, and said male locking member comprises a second mating surface and a locking projection that each correspond generally to the contour defined by said second axial edge so as to be nonlinear in said axial dimension, wherein said first and second mating surfaces meet and said locking recess is received by said locking projection when said cutting mat is installed on said rotary anvil.

14. A cutting mat for a rotary anvil according to claim 10, wherein said locking recess and said locking projection extend substantially the entire axial length of said cutting mat.

15. A cutting mat for a rotary anvil according to claim 10, further comprising a first support embedded within said female locking member, and a second support embedded within said male locking member.

16. A cutting mat for a rotary anvil according to claim 15, wherein said first support comprises a corrugated metal.

17. A cutting mat for a rotary anvil, the rotary anvil having a cylindrical periphery and an axial channel extending along the surface thereof, the cutting mat comprising:

a generally elongate cutting mat body having first and second major surfaces, opposing first and second axial edges arranged so as to be nonlinear in an axial dimension, a first end portion proximate said first axial edge, and a second end portion proximate said second axial edge;

a female locking member extending from said first end portion, said female locking member comprising:

a first side wall projecting generally normal to said cutting mat body in the direction of said first major surface facing towards said cutting mat body;

a base portion projecting from the end of said first side wall and generally normal thereto, a locking recess, and, a female mating face opposite said first side wall arranged such that at least a portion of said female mating face generally conforms to the contours defined by said first axial edge so as to be nonlinear in said axial dimension; and, a male locking member extending from said second end portion, said male locking member comprising:

a second side wall projecting generally normal to said cutting mat body in the direction of said first major surface and facing towards said cutting mat body;

a base portion projecting from the end of said second side wall and generally normal thereto, a locking projection, and, a male mating face opposite said second side wall arranged such that at least a portion of said male mating face generally conforms to the contours defined by said second axial edge so as to be nonlinear in said axial dimension, wherein said cutting mat is installable on said rotary anvil such that said body wraps around said cylindrical periphery, said male and female locking members insert generally within said channel, said male and female mating faces abut one another in mating relationship, and said locking projection is received within said locking recess such that said cutting mat is maintained on said rotary anvil without bolts, glue or latching strips.

18. A cutting mat according to claim 17, wherein said first and second axial edges comprise complimentary curvilinear patterns such that when said cutting mat is installed on said rotary anvil, said first and second axial edges are adjacent and in mating relationship defining a seam that is nonlinear.

19. A cutting mat according to claim 17, wherein said first and second axial edge comprise complimentary serpentine patterns such that when said cutting mat is installed on said rotary anvil, said first and second axial edges are adjacent and in mating relationship defining a seam that is nonlinear.

20. A cutting mat for a rotary anvil, the rotary anvil having a cylindrical periphery and an axial channel extending along the surface thereof, the cutting mat comprising:

a generally elongate body having a first major surface and a second major surface;

opposing first and second axial edges arranged to form a repeating curvilinear pattern such that said first and second axial edges are nonlinear in an axial dimension;

a first end portion proximate said first axial edge and a second end portion proximate said second axial edge;

a female locking member formed integral with said first end portion projecting generally normal thereto, said female locking member having a locking recess that extends continuously, substantially the axial length of said cutting mat; and, a male locking member formed integral with said second end portion projecting generally normal thereto, said male locking member having a locking projection that extends substantially the axial length of said cutting mat, wherein said cutting mat is adapted to be installed on said rotary anvil such that said body wraps around said cylindrical periphery, said male and female locking members meet in mating relationship within said channel and said locking projection is received in said locking recess such that said cutting mat is maintained on said rotary anvil and said first and second axial edges to define a seam that is nonlinear across the entire length thereof.

21. A cutting mat for a rotary anvil according to claim 20, wherein:

said female locking member further comprises:

a first side wall projecting generally normal to said cutting mat body in the direction of said first major surface facing towards said cutting mat body;

a base portion projecting from the end of said first side wall and generally normal thereto; and a female mating face opposite said first side wall, at least a portion of said female mating face generally conforming to the contours defined by said first axial edge so as to be nonlinear in said axial dimension; and, said male locking member comprises:

a second side wall projecting generally normal to said cutting mat body in the direction of said first major surface and facing towards said cutting mat body;

a base portion projecting from the end of said second side wall and generally normal thereto; and a male mating face opposite said second side wall, at least a portion of said male mating face generally conforming to the contours defined by said second axial edge, wherein said cutting mat is adapted to be installed on said rotary anvil such that said body wraps around said cylindrical periphery, said male and female locking members are positioned within said channel, said male and female mating faces abut one another in mating relationship, and said locking projection is received within said locking recess.

22. A cutting mat for a rotary anvil according to claim 20, wherein said first and second axial edges each form a complimentary curvilinear pattern such that when said body wraps around said cylindrical periphery of said rotary anvil, said male and female locking members meet in mating relationship within said channel to define a seam that is nonlinear.

23. A cutting mat for a rotary anvil according to claim 22, wherein said first and second axial edges each form a complimentary serpentine pattern.

24. A cutting mat for a rotary anvil according to claim 22, wherein said female locking member comprises a first mating surface that corresponds generally to the contour defined by said first axial edge and said male locking member comprises a second mating surface that corresponds generally to the contour defined by said second axial edge, wherein said first and second mating surfaces meet providing lateral support to said cutting mat when cutting mat is wrapped in said cylindrical shape.

* * * * *

UNITED STATES PATENT AND TRADEMARK OFFICE

CERTIFICATE OF CORRECTION

PATENT NO. : 6,629,482 B2
DATED : October 7, 2003
INVENTOR(S) : Elia et al.

It is certified that error appears in the above-identified patent and that said Letters Patent is hereby corrected as shown below:

Column 2,
Lines 31-34, "The female locking member slips into an axial channel on a rotray anvil. The cutting mat is wrapped around the rotary anvil, and the male member is inserted into the axial channel" should read -- The male and female locking members slip into an axial channel on a rotary anvil such that the male member is --;
Line 67, "using frictional forces only." should read -- without using bolts, glue or latching strips. --;

Column 5,
Line 49, "mating fact 150" should read -- mating face 150 --;
Lines 51-53, "The female locking member 116 is inserted into the channel 110 first. When the female locking member 116 is properly seated in the channel 110, the base portion 142 of" should read -- Referring to Fig. 5, when the female and male locking members 116, 118 are properly seated in the channel 110, the base portion 142 of --;
Line 58, "W of the channel floor as best illustrated in FIG. 5. Further," should read -- W of the channel floor. Further, --;

Column 5, lines 61-67 through Column 6, lines 1-3,
"After the female locking member 116 is properly seated in the channel 110, the cutting mat is wrapped around the rotary anvil, and the male locking member is inserted into the channel 110.
Referring to FIG. 5, when the male and female locking members 116 and 118 are properly seated in the channel 110, the base portion 142 of the female locking member 116 presses against the channel floor 156. The first sidewall 140 of the female locking member 116 presses against the first channel 152." should be deleted;

Column 6,
Lines 23-25, "It shall be observed that under this arrangement, the cutting mat 114 is releasably secured to the rotary anvil 102 by frictional forces only." should be deleted;
Line 43, "pressing against" should read -- is directed towards --;
Line 46, "presses against" should read -- is directed towards --;

Column 7,
Line 9, "a strong frictional mating" should read -- a strong mating --;
Line 10, "realized by compressing" should read -- realized by pressing --; and

UNITED STATES PATENT AND TRADEMARK OFFICE

CERTIFICATE OF CORRECTION

PATENT NO. : 6,629,482 B2
DATED : October 7, 2003
INVENTOR(S) : Elia et al.

It is certified that error appears in the above-identified patent and that said Letters Patent is hereby corrected as shown below:

Column 12,
Line 55, "axial edge" should read -- axial edge, --.

Signed and Sealed this

Twenty-eighth Day of September, 2004

JON W. DUDAS
*Director of the United States Patent and Trademark Office*